US006807763B1

(12) United States Patent
Leung

(10) Patent No.: US 6,807,763 B1
(45) Date of Patent: Oct. 26, 2004

(54) CLOSE COMBAT BUTT STOCK FOR ASSAULT WEAPONS

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/719,853

(22) Filed: Nov. 21, 2003

(51) Int. Cl.[7] ..... F41C 23/00

(52) U.S. Cl. ..... 42/71.01; 42/72; 42/73; 42/69.01; 89/136

(58) Field of Search ..... 42/71.01, 72, 73, 42/69.01; 89/136

(56) References Cited

U.S. PATENT DOCUMENTS

| | | | | | |
|---|---|---|---|---|---|
| 1,260,285 | A | * | 3/1918 | Cordell | 42/118 |
| 1,300,688 | A | * | 4/1919 | Bellard | 42/118 |
| 2,627,132 | A | * | 2/1953 | Simonas | 42/118 |
| 4,878,305 | A | * | 11/1989 | Gabrielidis | 42/72 |
| 6,598,329 | B1 | * | 7/2003 | Alexander | 42/71.01 |

* cited by examiner

*Primary Examiner*—J. Woodrow Eldred

(74) *Attorney, Agent, or Firm*—Michael Zelenka; George B. Teresehuk

(57) ABSTRACT

A close combat butt stock apparatus for an assault weapon is provided with a slideable cover for a close combat butt stock assembly that is positioned behind a first pistol grip and a first trigger of the assault weapon. The close butt stock assembly has an interior opening that defines a close combat handle and a hand shield. A second trigger is also built into the interior opening. With the close combat butt stock apparatus, the military and law enforcement user can now safely and efficiently hold the assault weapon in the bayonet and close quarter combat position with the firing hand holding the close quarter combat handle so that the firing hand is much closer to a second trigger. Maintaining the bayonet and close quarter combat position with the firing hand next to the second trigger permits the user to fire the weapon much more quickly than before, which will optimize the handling of the assault weapon during bayonet and close quarter fighting, protect the firing hand during bayonet and close quarter fighting, provide the user the means to fire the weapon during bayonet and close quarter fighting and extend the striking range of the rifle butt stock during close quarter fighting. Other embodiments include an assault weapon, an assault rifle, an assault weapon equipped with a close combat butt stock assembly and a method for rapidly engaging a second trigger of a close combat butt stock assembly of an assault weapon.

36 Claims, 3 Drawing Sheets

CLOSE COMBAT BUTT STOCK FOR ASSAULT WEAPONS

GOVERNMENT INTEREST

The invention described herein may be manufactured, used, imported, sold, and licensed by or for the Government of the United States of America without the payment to me of any royalty thereon.

FIELD OF THE INVENTION

The invention generally relates to firearms and assault weapons. In particular, the invention relates to apparatus and methods providing a close combat butt stock apparatus for assault weapons for increased protection and safety of military and law enforcement users during bayonet and close combat operations.

BACKGROUND OF THE INVENTION

Most current assault weapons, including assault rifles, are designed for the military and law enforcement users to quickly raise the weapon from a carrying position to a shouldered firing position in a single motion. Separating the trigger and butt stock with a pistol grip facilitates the movement from the carrying position to the shouldered firing position. Military and law enforcement users must still face lethal close combat situations during which the assault weapon is held in a different position known as the bayonet and close quarter combat position wherein the assault weapon is held across the chest and not shouldered. There has been a long-standing need for an assault weapon that permits a rapid movement from the carrying position to a close combat position, without sacrificing important features that allow the weapon to be quickly shouldered for the firing position.

FIG. 1 illustrates a prior art assault weapon 10 in the carrying position. The prior art assault weapon 10 is equipped with conventional butt stock 11, pistol grip 12, trigger 13 and bayonet 14. Arrow 15 represents the upward movement from the carrying position to the shouldered firing position. In the carrying position, the user's firing hand holds the pistol grip 12 with the index finger on the trigger 13 in preparation for a sudden unexpected tactical situation in which the user must rapidly switch to the shouldered firing position.

Referring now to FIG. 2, where the same numerals are employed for like structures, the military and law enforcement user is depicted holding the prior art assault weapon 10 in the position employed for bayonet and close quarter fighting. In the bayonet and close quarter position, the soldier carries the prior art assault weapon 10 across the soldier's body with the firing hand on the conventional butt stock 11 instead of the pistol grip 12. When the firing hand is holding the conventional butt stock 11 instead of the pistol grip 12, the military and law enforcement user is unable to quickly pull the trigger 13 without first moving the firing hand from the conventional butt stock 11 to the pistol grip 12 and trigger 13 while the user is raising the weapon 10 to his shoulders. If the user is initially holding the weapon 10 in the close quarter combat position and must then fire the weapon 10 quickly because of a sudden enemy ambush attack or close quarter combat, the user must rapidly reposition his firing hand to the pistol grip 12 and trigger 13.

FIG. 2 clearly illustrates the problems, shortcomings and deficiencies of the prior art assault weapon by showing the firing hand away from the pistol grip 12 and trigger 13. Loss of life or injury in tactical situations can easily result from the user failing to quickly move the firing hand in sufficient time. Up until now, a user holding the prior art assault weapon 10 in the close quarter combat position is unable to maintain that position with the firing hand holding the pistol grip 12 and trigger 13. Other problems, shortcomings and deficiencies arising from holding the prior art assault weapon 10 in the bayonet and close quarter combat carrying position include injury to the knuckles and hands that are left exposed and unprotected. Further, the prior art assault weapon 10 cannot be optimized for rapid and smooth movement during close quarter combat like a Pugil stick.

Thus there has been a long-felt need for an assault weapon with a butt stock allowing the user to simultaneously hold the weapon in the bayonet and close quarter combat position while keeping the firing hand ready to pull the trigger, without the clumsy, time-consuming and dangerous movement of the firing hand from the conventional butt stock 11 to the trigger 13. The present invention fulfills this long-felt need with a close combat butt stock apparatus for assault weapons that solves the long-standing problems, shortcomings and deficiencies of prior art weapons by providing a butt stock with a slideable cover that can be readily extended to reveal a close quarter combat assembly comprising a close combat carrying handle, second trigger and hand shield built into the assault weapon butt stock so that the user can efficiently hold the weapon's butt stock with a firing hand much closer to a second trigger permitting the user to fire the weapon much more quickly than before, without suffering from the problems, shortcomings and deficiencies of prior art weapons.

SUMMARY OF THE INVENTION

It is an object of the present invention to provide a close combat butt stock apparatus for assault weapons with a slideable cover and a second trigger for bayonet and close quarter combat operations with assault weapons.

It is another object of the present invention to provide a close combat butt stock apparatus for assault weapons with a slideable cover and a close combat carrying assembly having a close combat handle, a second trigger and hand shield that are built into the assault weapon butt stock.

It is a further object of the present invention to provide methods for positioning the firing hand on a close combat handle of an assault weapon permitting the user to rapidly engage a second trigger and hand shield.

These and other objects and advantages can now be attained by this invention's close combat butt stock apparatus for assault weapon, comprising a slideable covers for a close quarter combat assembly further comprising a close combat carrying handle, a second trigger and hand shield built into the assault weapon butt stock. In accordance with the present invention, the military and law enforcement user can now safely and efficiently hold the assault weapon in the bayonet and close quarter combat position with the firing hand much closer to a second trigger. Maintaining the bayonet and close quarter combat position with the firing hand next to the second trigger permits the user to fire the weapon much more quickly than before, without suffering from the problems, shortcomings and deficiencies of prior art weapons. The close combat butt stock apparatus of the present invention comprises a slideable cover that covers a close combat butt stock assembly having a close combat carrying handle, second trigger and hand shield. By incorporating this invention's close combat butt stock apparatus into current military and law enforcement arsenals, these weapons will now optimize the handling of the weapon during bayonet and close quarter fighting, protect the firing hand during bayonet and close quarter fighting, provide the user the means to fire the weapon during bayonet and close quarter fighting and extend the striking range of the rifle butt stock during close quarter fighting, without suffering from the problems, disadvantages and shortcomings of prior art assault weapons. Other embodiments including an assault weapon, an assault rifle, an assault weapon equipped with a close combat butt stock assembly and a method for rapidly engaging a second trigger of a close combat butt stock assembly of an assault weapon are also considered to be within the contemplation of the present invention.

DETAILED DESCRIPTION OF THE DRAWINGS

Figure 1:
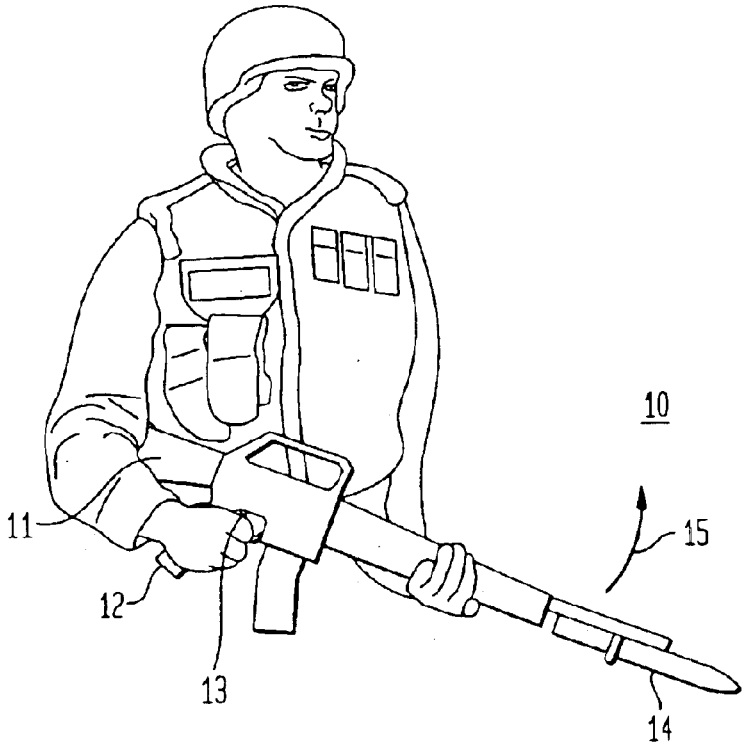
FIG. 1 (PRIOR ART)
FIG. 1 depicts a prior art assault weapon in the carrying position.
Figure 2:
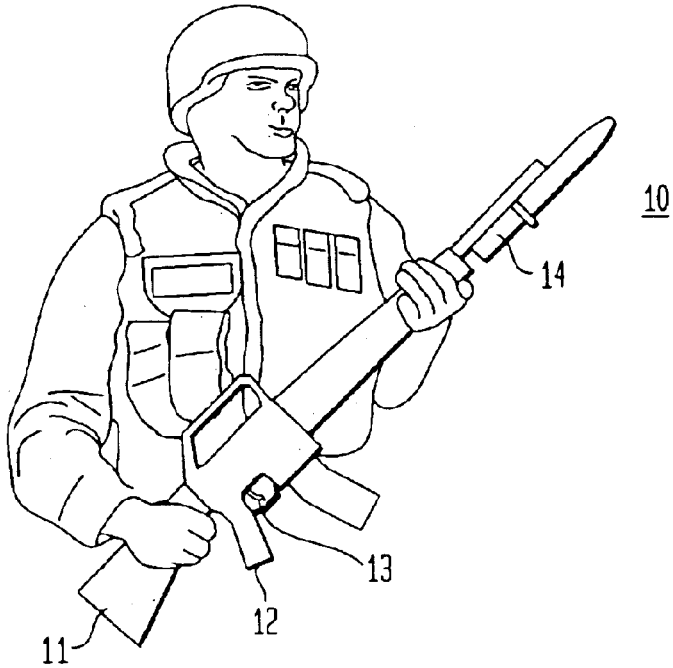
FIG. 2 (PRIOR ART)
FIG. 2 depicts a prior art assault weapon in the bayonet and close combat position.

FIGS. 1 and 2 illustrate the problems, shortcomings and deficiencies of prior art assault weapons with a conventional butt stock. Whenever the military and law enforcement users were required to hold the weapon in the bayonet and close quarter combat position, the firing hand is positioned on the conventional butt stock and several inches away from the pistol handle and trigger, requiring the user to simultaneously move the weapon and firing hand in order to reposition the firing hand on the pistol handle. In accordance with the close combat butt stock apparatus of the present invention, the military and law enforcement user can now extend the slideable butt stock cover and position the firing hand onto a close combat handle with an advantageously located second trigger permitting the military and law enforcement user to now safely and efficiently hold the assault weapon in the bayonet and close quarter combat position with the firing hand substantially closer to a second trigger.

Figure 3A:
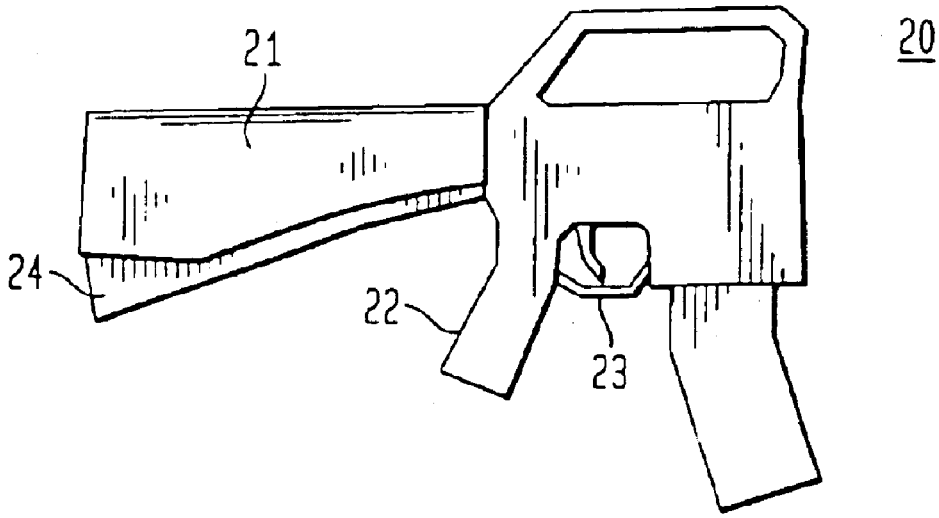
FIGS. 3A–3B are side views of the close combat butt stock apparatus of the present invention illustrating the apparatus with the slideable cover in the open and closed positions.
Figure 3B:
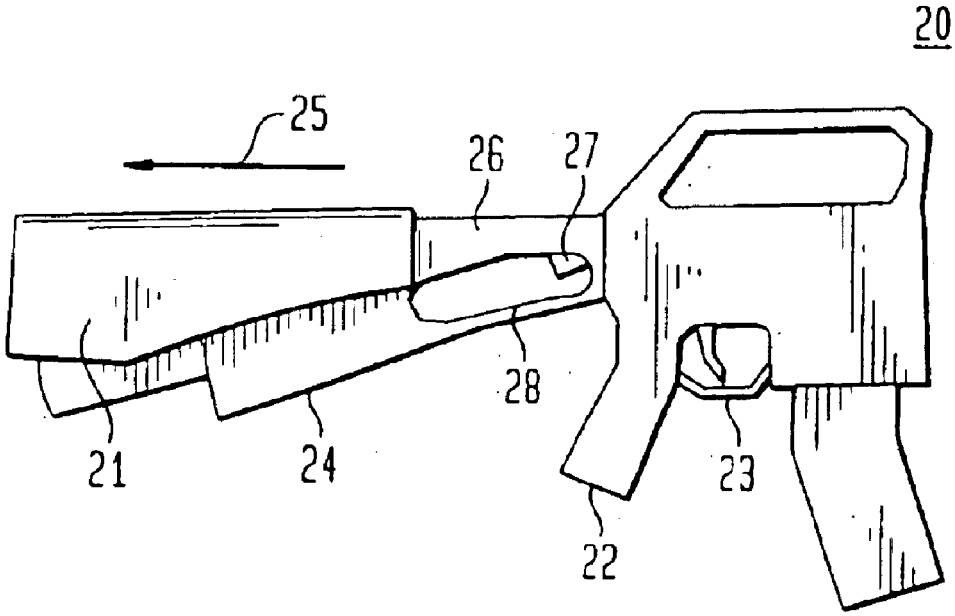

Referring now to FIG. 3A, there is depicted an assault weapon 20 with a butt stock cover 21 of the close combat butt stock apparatus of the present invention in the closed position. When the cover 21 is in the closed position, the close combat butt stock assembly 24 is covered and the butt stock portion of the assault weapon 20 appears similar to the prior art butt stock 11 depicted in FIGS. 1 and 2. FIG. 3A also depicts a standard first pistol grip 22 and a first trigger 23. Referring now to FIG. 3B, where the same numerals are employed for like structures, assault weapon 20 is depicted with the butt stock cover 21 of the close combat butt stock apparatus in an open extended position, indicated by arrow 25, with the butt stock cover 21 fully extended away from the first pistol grip 22. Once the military and law enforcement user opens and extends the butt stock cover 21, a close combat handle 26, a second trigger 27 and a hand shield 28 are all exposed. A means for locking the butt stock cover 21, not shown, locks the cover 21 over the close combat butt stock assembly 24 and a means for trigger control can control the triggers.

Figure 4:
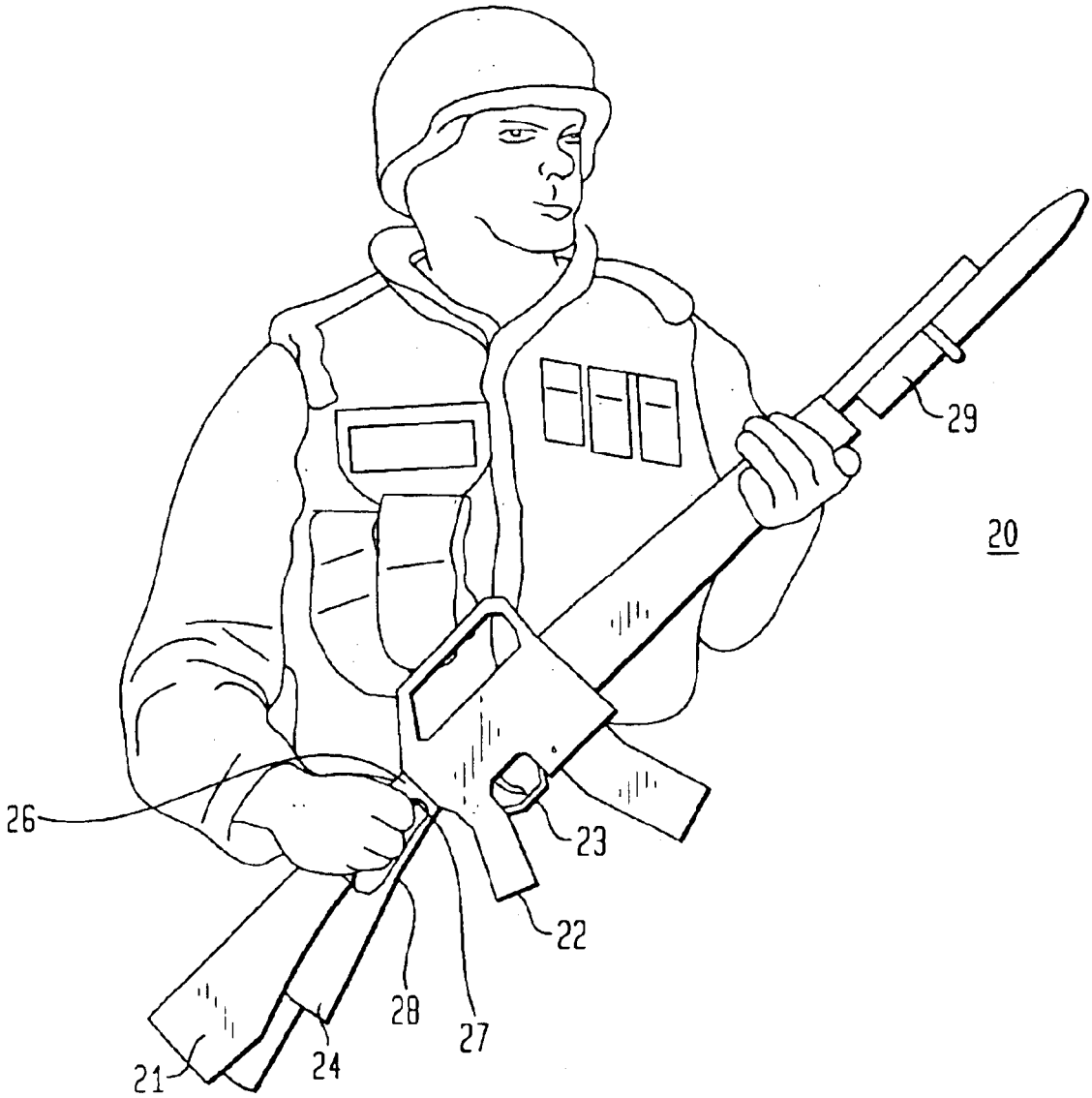
FIG. 4 depicts the close combat butt stock apparatus on an assault weapon in accordance present invention.

FIG. 4 depicts the military and law enforcement user holding the assault weapon 20 in the bayonet and close quarters combat position with the firing hand holding the close combat handle 26. In accordance with the close combat butt stock apparatus of the present invention, the military and law enforcement user can now rapidly swing and thrust the assault weapon 20 much more naturally, pull the second trigger 27 to fire the weapon and protect the knuckles of his firing hand with the hand shield 28 during close quarter fighting. The extended configuration also lengthens the weapon's butt stock, which increases the effective striking radius of the butt stock during close quarter combat.

A number of variations to the close combat butt stock apparatus are considered to be within the contemplation of this invention, including positioning the close combat butt assembly in the vicinity of the first pistol grip, locating the second trigger within the interior opening, the user rapidly engaging the second trigger with the firing hand while holding a weapon in a bayonet and close quarters combat position and having the interior opening dimensioned sufficiently large for the firing hand to rapidly grasp the close combat handle. The slideable cover may have a means for locking the slideable cover and, during the closed position, the slideable cover covers the close combat butt assembly when not in use and protects the close combat butt stock assembly when the weapon is held in other positions and the assault weapon being an assault rifle Other embodiments of the present invention include an assault weapon, an assault rifle, an assault weapon equipped with a close combat butt stock assembly and a method for rapidly engaging a second trigger of a close combat butt stock assembly of an assault weapon, along with variations thereto that are similar to the close combat butt stock apparatus.

The present in invention also contemplates a method for rapidly engaging a second trigger of a close combat butt stock assembly of an assault weapon, comprising the steps of providing an interior opening of the close combat butt assembly to define a close combat handle and a hand shield, positioning the second trigger in the interior opening, placing a slideable cover over the close combat butt stock assembly and forming the slideable cover to have an open position and a closed position. During a positioning step, the close combat butt stock assembly is positioned in the vicinity of a first pistol grip and in an opposite direction from a gun barrel and a first trigger of the assault weapon. In a dimensioning step the interior opening is dimensioned sufficiently large for a user's hand to hold the said close combat handle. In a selecting step, the user selects the open position, thus permitting the user to grasp the close combat handle with the firing hand being in a close proximity to the second trigger to rapidly engage the second trigger when holding the assault weapon in a bayonet and close quarters combat position. Many of the variations that are possible with the other embodiments of the present invention are also considered to be within the contemplation of the method of the present invention.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, geometrical arrangements and dimensions can achieve the results described herein, without departing from the spirit and scope of this invention. Accordingly, the present invention should not be limited by the foregoing description, but only by the appended claims.

What I claim is:

1. A close combat butt stock apparatus for an assault weapon, comprising:

a close combat butt stock assembly is positioned behind a first pistol grip and a first trigger of said assault weapon;

said close combat butt stock assembly having a slideable cover, an interior opening that defines a close combat handle and a hand shield and a second trigger; and said slideable cover being open and extended permits a user to grasp said close combat handle with a firing hand being in close proximity to said second trigger to rapidly engage said second trigger with said firing hand.

2. The close combat butt stock apparatus for the assault weapon, as recited in claim 1, further comprising said close combat butt assembly being positioned in the vicinity of said first pistol grip.

3. The close combat butt stock apparatus for the assault weapon, as recited in claim 2, further comprising said second trigger being located within said interior opening.

4. The close combat butt stock apparatus for the assault weapon, as recited in claim 3, further comprising said user rapidly engaging said second trigger with said firing hand while holding said assault weapon in a bayonet and close quarters combat position diagonally across said user's body.

5. The close combat butt stock apparatus for the assault weapon, as recited in claim 4, further comprising said interior opening being dimensioned sufficiently large for said firing hand to rapidly grasp said close combat handle.

6. The close combat butt stock apparatus for the assault weapon, as recited in claim 5, further comprising said slideable cover having a means for locking said cover.

7. The close combat butt stock apparatus for the assault weapon, as recited in claim 6, further comprising said slideable cover covering said close combat butt assembly when not in use.

8. The close combat butt stock apparatus for the assault weapon, as recited in claim 7, further comprising said close combat butt stock assembly being protected by said slideable cover when said user holds said assault weapon in a plurality of other positions.

9. The close combat butt stock apparatus for the assault weapon, as recited in claim 8, further comprising said assault weapon being an assault rifle.

10. An assault weapon, comprising:

a first trigger;

a first pistol grip;

a gun barrel;

a close combat butt stock assembly having a slideable cover, an interior opening that defines a close combat handle and a hand shield and a second trigger;

said second trigger being located within said interior opening;

said close combat butt stock assembly being located in the vicinity of said first pistol grip pointing in an opposite direction from said gun barrel;

said slideable cover having an open position and a closed position;

said interior opening being dimensioned sufficiently large for a user's hand to hold said close combat handle; and said open position permits a user to grasp said close combat handle with said firing hand being in a close proximity to said second trigger to rapidly engage said second trigger when holding said assault weapon in a bayonet and close quarters combat position.

11. The assault weapon, as recited in claim 10, further comprising said close combat butt assembly being positioned in the vicinity of said first pistol grip and said first trigger.

12. The assault weapon, as recited in claim 11, further comprising said first trigger and said second trigger being controlled by a means for trigger control.

13. The assault weapon, as recited in claim 12, further comprising said user rapidly engaging said second trigger with said firing hand while holding said assault weapon in a bayonet and close quarters combat position diagonally across said user's body.

14. The assault weapon,.as recited in claim 13, further comprising said slideable cover having a means for locking said cover.

15. The assault weapon, as recited in claim 14, further comprising said slideable cover covering said close combat butt assembly in said closed position.

16. The assault weapon, as recited in claim 15, further comprising said close combat butt stock assembly being protected by said slideable cover in said closed position when said user holds said assault weapon in a plurality of other positions.

17. The assault weapon, as recited in claim 16, further comprising said assault weapon being an assault rifle.

18. An assault rifle, comprising:

a first trigger;

a first pistol grip;

a gun barrel;

a close combat butt stock assembly having a slideable cover, an interior opening that defines a close combat handle and a hand shield and a second trigger;

said second trigger being located within said interior opening;

said close combat butt stock assembly being located in the vicinity of said first pistol grip pointing in an opposite direction from said gun barrel;

said slideable cover having an open position and a closed position;

said interior opening being dimensioned sufficiently large for a user's hand to hold said close combat handle; and said open position permits a user to grasp said close combat handle with said firing hand being in a close proximity to said second trigger to rapidly engage said second trigger when holding said assault rifle in a bayonet and close quarters combat position.

19. The assault rifle, as recited in claim 18, further comprising said close combat butt assembly being positioned in the vicinity of said first pistol grip and said first trigger.

20. The assault rifle, as recited in claim 19, further comprising said first trigger and said second trigger being controlled by a means for trigger control.

21. The assault rifle, as recited in claim 20, further comprising said user rapidly engaging said second trigger with said firing hand while holding said assault rifle in a bayonet and close quarters combat position diagonally across said user's body.

22. The assault rifle, as recited in claim 21, further comprising said slideable cover having a means for locking said cover.

23. The assault rifle, as recited in claim 22, further comprising said slideable cover covering said close combat butt assembly in said closed position.

24. The assault rifle, as recited in claim 23, further comprising said close combat butt stock assembly being protected by said slideable cover in said closed position when said user holds said assault weapon in a plurality of other positions.

25. An assault weapon equipped with a close combat butt stock assembly, comprising:

a first trigger;

a first pistol grip;

a gun barrel;

said close combat butt stock assembly having a slideable cover, an interior opening that defines a close combat handle and a hand shield and a second trigger;

said second trigger being located within said interior opening;

said close combat butt stock assembly being located in the vicinity of said first pistol grip pointing in an opposite direction from said gun barrel;

said slideable cover having an open position, a closed position and a means for locking said slideable covers;

said interior opening being dimensioned sufficiently large for a user's hand to hold said close combat handle; and said open position permits a user to grasp said close combat handle with said firing hand being in a close proximity to said second trigger to rapidly engage said second trigger when holding said assault weapon in a bayonet and close quarters combat position diagonally across said user's body.

26. The assault weapon equipped with the close combat butt stock assembly, as recited in claim 25, further comprising said close combat butt assembly being positioned in the vicinity of said first pistol grip and said first trigger.

27. The assault weapon equipped with the close combat butt stock assembly, as recited in claim 26, further comprising said first trigger and said second trigger being controlled by a means for trigger control.

28. The assault weapon equipped with the close combat butt stock assembly, as recited in claim 27, further comprising said slideable cover covering said close combat butt assembly in said closed position.

29. The assault weapon equipped with the close combat butt stock assembly, as recited in claim 28, further comprising said close combat butt stock assembly being protected by said slideable cover in said closed position when said user holds said assault weapon in a plurality of other positions.

30. A method for rapidly engaging a second trigger of a close combat butt stock assembly of an assault weapon, comprising the steps of:

providing an interior opening of said close combat butt assembly to define a close combat handle and a hand shield;

positioning said second trigger in said interior opening;

placing a slideable cover over said close combat butt stock assembly;

forming said slideable cover to have an open position and a closed position;

positioning said close combat butt stock assembly in the vicinity of a first pistol grip and in an opposite direction from a gun barrel and a first trigger of said assault weapon;

dimensioning said interior opening sufficiently large for a user's hand to hold said close combat handle;

selecting said open position; and permitting a user to grasp said close combat handle with said firing hand being in a close proximity to said second trigger to rapidly engage said second trigger when holding said assault weapon in a bayonet and close quarters combat position.

31. The method for rapidly engaging said second trigger of the close combat butt stock assembly of the assault weapon, as recited in claim 30, further comprising the step of controlling said first trigger and said second trigger with a means for trigger control.

32. The method for rapidly engaging said second trigger of the close combat butt stock assembly of the assault weapon, as recited in claim 31, further comprising the step of rapidly engaging said second trigger while holding said assault weapon diagonally across said user's body with said firing hand and another hand during said bayonet and close quarters combat position.

33. The method for rapidly engaging said second trigger of the close combat butt stock assembly of the assault weapon, as recited in claim 32, further comprising the step of providing said slideable cover with a means for locking said slideable cover.

34. The method for rapidly engaging said second trigger of the close combat butt stock assembly of the assault weapon, as recited in claim 33, further comprising the step of covering said close combat butt stock assembly with said slideable cover in the closed position.

35. The method for rapidly engaging said second trigger of the close combat butt stock assembly of the assault weapon, as recited in claim 34, further comprising the step of protecting said close combat butt stock assembly with said slideable cover in the closed position when said user holds said assault weapon in a plurality of other positions.

36. The method for rapidly engaging said second trigger of the close combat butt stock assembly of the assault weapon, as recited in claim 35, wherein said assault weapon is an assault rifle.

* * * * *